US005312082A

United States Patent [19]

Chang

[11] Patent Number: 5,312,082

[45] Date of Patent: May 17, 1994

[54] CLIPBOARD HAVING A WHISTLE INTEGRALLY FORMED THEREWITH

[76] Inventor: Shih-Ho Chang, No.2-12, Chang-Lu Rd., Changhua City, Taiwan

[21] Appl. No.: 38,699

[22] Filed: Mar. 29, 1993

[51] Int. Cl.[5] ..... A47B 97/04

[52] U.S. Cl. ..... 248/452; 248/441.1

[58] Field of Search ..... 248/452, 451, 453, 176, 248/221.4, 441.1; 116/137 R, 140, DIG. 18, DIG. 19; 84/330, 453

[56] References Cited

U.S. PATENT DOCUMENTS

| | | | |
|---|---|---|---|
| 2,492,034 | 12/1949 | Clyne | 248/452 X |
| 2,782,748 | 2/1957 | Zegarowitz | 116/137 R |
| 4,709,651 | 12/1987 | Lance | 116/137 R |
| 4,892,334 | 1/1990 | Sinclair | 248/441.1 X |
| 5,040,673 | 8/1991 | Huang et al. | 116/139 |
| 5,086,726 | 2/1992 | Sharp | 116/137 R |
| 5,180,133 | 1/1993 | Chang | 248/452 |

*Primary Examiner*—David A. Scherbel
*Assistant Examiner*—Korie H. Chan
*Attorney, Agent, or Firm*—Cushman, Darby & Cushman

[57] ABSTRACT

A clipboard includes a backing board on which a clip member is mounted pivotally, a torsional spring unit arranged between the backing board and the clip member so as to bias one end of the clip member to abut against the backing board, and a whistle formed integrally with the clip member.

3 Claims, 6 Drawing Sheets

CLIPBOARD HAVING A WHISTLE INTEGRALLY FORMED THEREWITH

BACKGROUND OF THE INVENTION

1. Field Of The Invention

This invention relates to a clipboard, more particularly to a clipboard that has a whistle formed thereon.

2. Description Of The Related Art

Some people, such as policemen, referees, etc., require a clipboard and a whistle while at work. For these people, forgetting to carry either the whistle or the clipboard can cause a great deal of inconvenience.

SUMMARY OF THE INVENTION

Therefore, the main object of this invention is to provide a clipboard which has a whistle formed thereon.

According to this invention, a clipboard includes a backing board, a clip member, a torsional spring unit and a whistle. The backing board has a first end portion on which the clip member is mounted pivotally. The clip member has a pressing end and a retaining end. The torsional spring unit is disposed between the backing board and the clip member and biases the retaining end of the clip member to abut against the backing board. The whistle includes a first housing part, a second housing part and a sound ball. The first housing part is formed integrally with the clip member and has two opposed walls that extend vertically outward from the clip member and that are spaced apart from each other. Each of the opposed walls has a rectangular wall portion that extends from the pressing end toward the retaining end and a generally circular wall portion that is connected to one end of the rectangular wall portion. The other end of each of the rectangular wall portions projects outward from the pressing end of the clip member. The clip member has an extension which projects outward from the pressing end thereof and which extends between the other ends of the rectangular wall portions. The first housing part further has a sound slit which is formed through the clip member and which is disposed between the generally circular wall portions adjacent to the rectangular wall portions. The second housing part has a rectangular plate and a curved plate connected to one end of the rectangular plate. The second housing part is connected securely to the first housing part so that the generally circular wall portions of the first housing part and the curved plate of the second housing part cooperatively define an air space thereamong. The sound ball is disposed movably in the air space.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
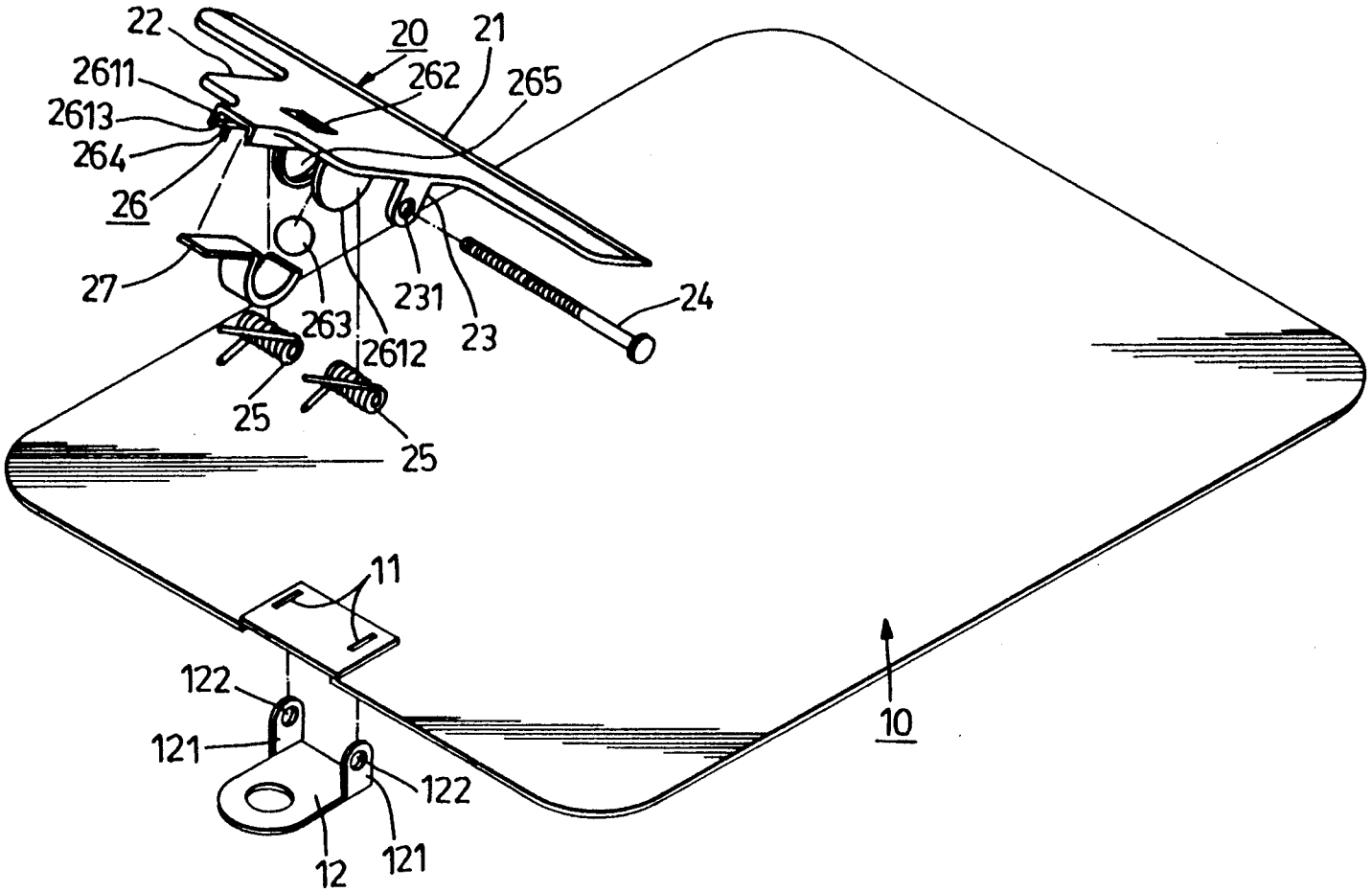
FIG. 1 is an exploded perspective view of a clipboard according to a first embodiment of this invention.
Figure 2:
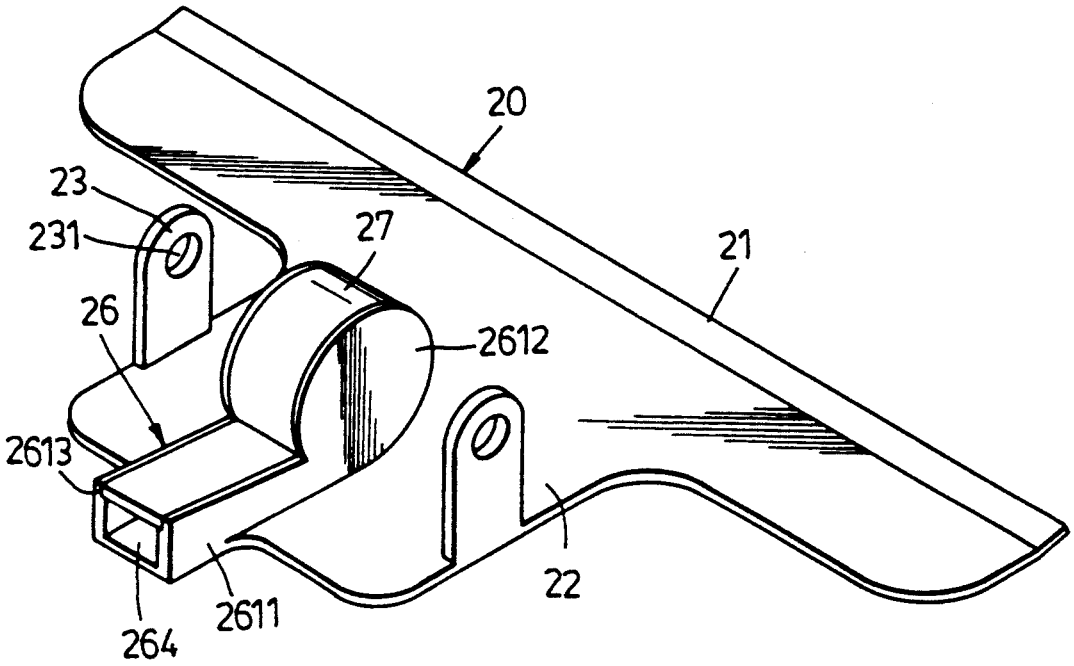
FIG. 2 is a rear perspective view showing the clip member of the clipboard according to the first embodiment of this invention.
Figure 3:
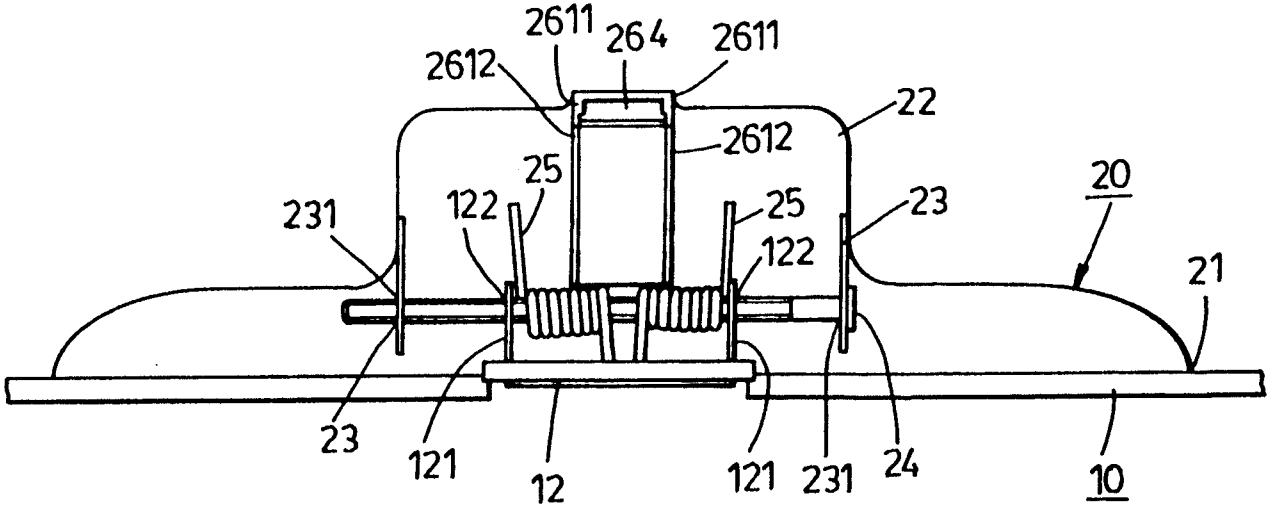
FIG. 3 is a front view of the clipboard according to the first embodiment of this invention.
Figure 4:
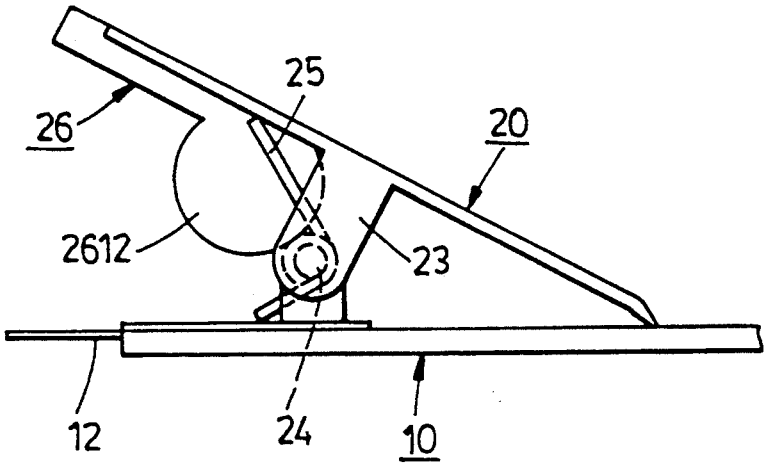
FIG. 4 is a fragmentary side view of the clipboard according to the first embodiment of this invention.

Referring to FIGS. 1 to 4, a first embodiment of a clipboard according to this invention includes a backing board (10), a clip member (20), two torsional spring units (25) and a whistle The backing board (10) is a one-piece board that has two aligned positioning holes (11) formed in the central portion of a first end thereof. A supporting base member (12) is connected securely to the backing board (10) and has two projections (121) that project vertically outward so as to extend through the positioning holes (11) in the backing board (10). Two aligned locating holes (122) are formed respectively in the distal end portion of the projections (121) of the supporting base member (12).

The clip member (20) is a one-piece plate and has a pressing end (22) and a retaining end (21) that is formed integrally with the pressing end (22). The width of the retaining end (21) is greater than that of the pressing end (22). Two lugs (23) extend vertically outward from two opposite edges of the pressing end (22). A pivot hole (231) is formed in the distal end of each of the lugs (23). The clip member (20) is connected pivotally to the projections (121) of the supporting base member (12) by means of a pivot axle (24) which extends through the pivot holes (231) in the lugs (23) of the clip member (20), the locating holes (122) in the projections (121) of the supporting base member (12) and the torsional spring units (25). The torsional spring units (25) are arranged between the backing board (10) and the clip member (20) so as to bias the retaining end (21) of the clip member (20) to abut against the backing board (10) for holding sheets of papers on the backing board (10).

The whistle includes a first housing part (26), a second housing part (27) and a sound ball (263). The first housing part (26) is formed integrally with the clip member (20) and has two opposed walls (261) that extend vertically outward from the clip member (20) and that are spaced apart from each other. Each of the opposed walls (261) has a rectangular wall portion (2611) that extends from the pressing end (22) toward the retaining end (21) and a generally circular wall portion (2612) that is connected to one end of the rectangular wall portion (2611). The other end of each of the rectangular wall portions (2611) projects outward from the pressing end (22) of the clip member (20). Each of the opposed walls (261) has an outermost side surface that is formed with a longitudinally extending groove (2613) to engage a corresponding one of two longitudinal edges of the second housing part (27). The clip member (20) has an extension which projects outward from the pressing end (22) thereof and which extends between the other ends of the rectangular wall portions (2611). The first housing part (26) has a sound slit (262) which is formed through the clip member (20) and which is disposed between the generally circular wall portions (2612) adjacent to the rectangular wall portions (2611). The second housing part (27) has a rectangular plate and a curved plate connected to one end of the rectangular plate. The second housing part (27) is connected securely to the first housing part (26) so that the generally circular wall portions (2612) of the first housing part (26) and the curved plate of the second housing part (27) cooperatively define an air space (265) thereamong and so that the rectangular plate of the second housing part (27), the extension of the clip member (20) and the other ends of the opposed walls (261) cooperatively define an air mouth (264) thereamong. The sound ball (263) is disposed movably in the air space.

Figure 5:
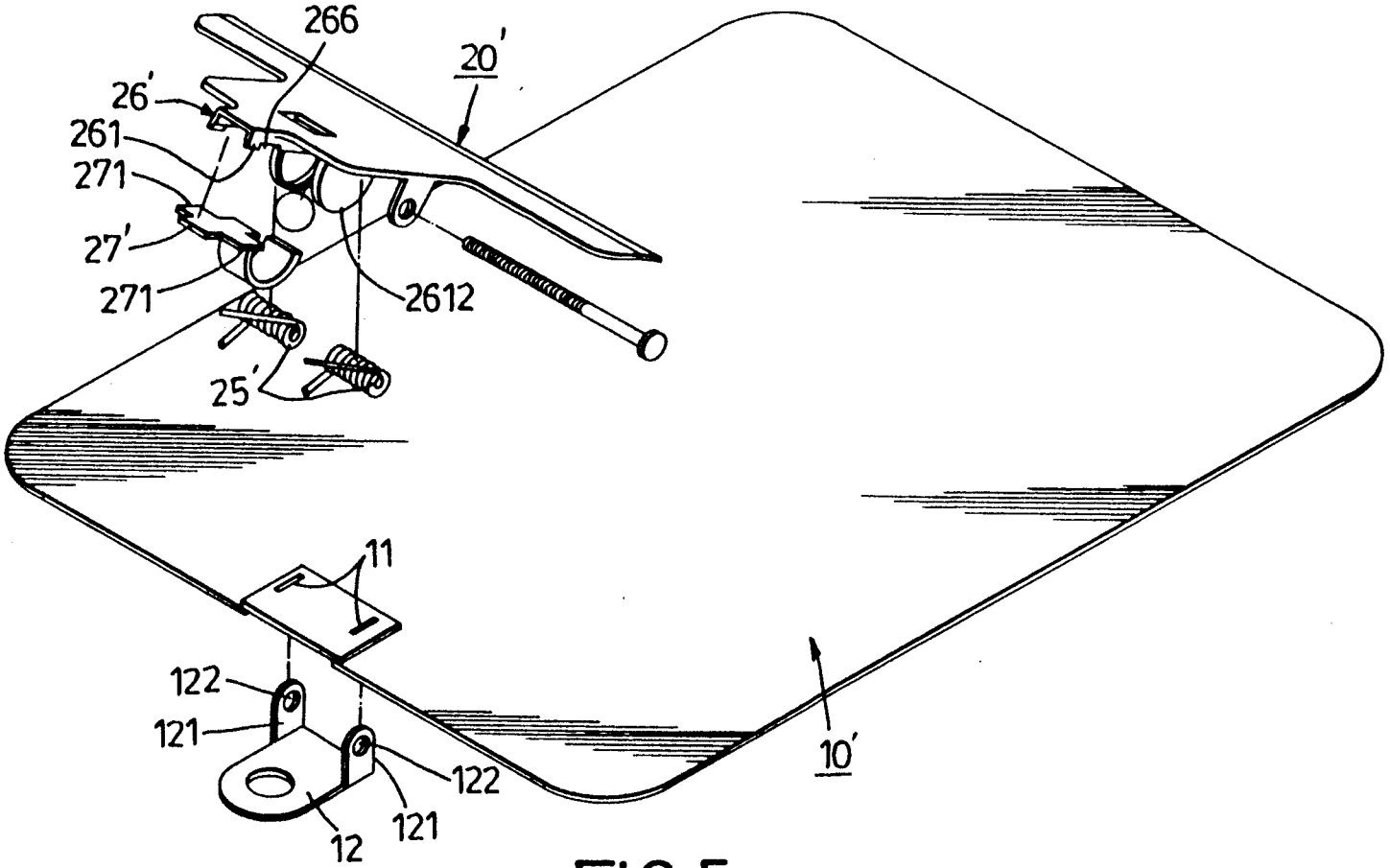
FIG. 5 is an exploded perspective view of a clipboard according to a second embodiment of this invention.
Figure 6:
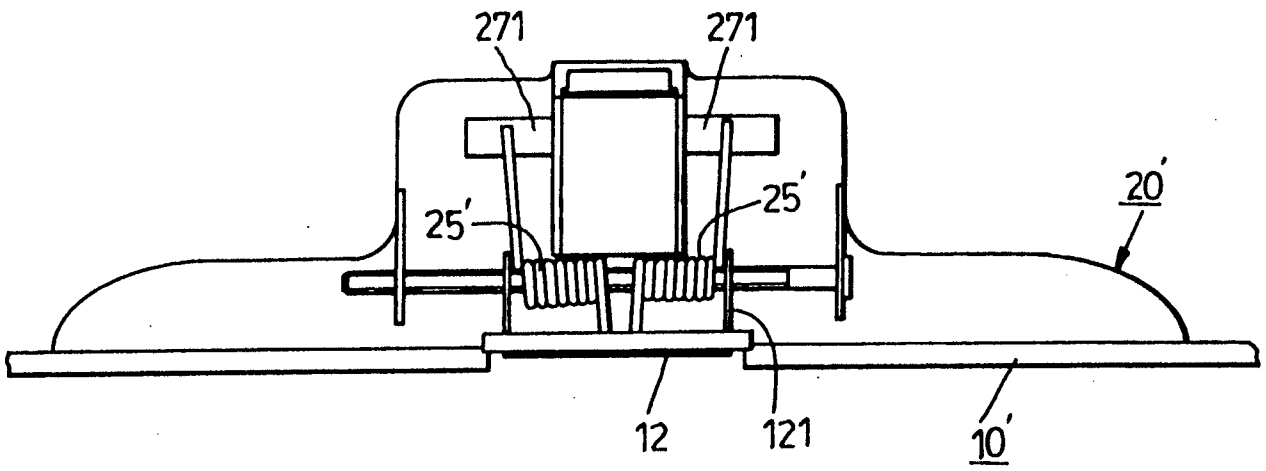
FIG. 6 is a front view of the clipboard according to the second embodiment of this invention.

Referring to FIGS. 5 and 6, a second embodiment of the clipboard according to this invention is shown. Unlike the first embodiment, each of the opposed walls (261') has a positioning groove (266) formed in the outermost side surface thereof. The second housing part (27') has two retaining plates (27) projecting respectively outward from the longitudinal edges thereof so as to extend respectively through the positioning grooves (266) in the first housing part (26'). The torsional spring units (25') press against an outer end portion of a respective one of the retaining plates (271), thereby providing a more secure engagement between the first and second housing parts (26',27').

It has thus been shown that the clipboard of the present invention is formed with a whistle. This obviates the need for carrying an additional whistle as required in the prior art.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A clipboard including a backing board having a first end portion; a clip member mounted pivotally on said first end portion of said backing board, said clip member having a pressing end and a retaining end; and a torsional spring unit which is disposed between said backing board and said clip member and which has two ends abutting respectively against said clip member and said backing board so as to bias said retaining end of said clip member to abut against said backing board, wherein the improvement comprises:

a whistle including: a first housing part which is formed integrally with said clip member and which has two opposed walls that extend vertically outward from said clip member and that are spaced apart from each other, each of said opposed walls having a rectangular wall portion that extends from said pressing end toward said retaining end and a generally circular wall portion that is connected to one end of said rectangular wall portion, the other end of each of said rectangular wall portions projecting outward from said pressing end of said clip member, said clip member having an extension which projects outward from said pressing end of said clip member, said clip member having an extension which projects outward from said pressing end thereof and which extends between said other ends of said rectangular wall portions, said first housing part further having a sound slit which is formed through said clip member and which is disposed between said generally circular wall portions adjacent to said rectangular wall portions; a second housing part having a rectangular plate and a curved plate connected to one end of said rectangular plate, said second housing part being connected securely to said first housing part so that said generally circular wall portions of said first housing part and said curved plate of said second housing part cooperatively define an air space thereamong; and a sound ball disposed movably in said air space.

2. A clipboard as claimed in claim 1, wherein each of said opposed walls has an outermost side surface formed with a longitudinally extending groove to engage a corresponding one of two longitudinal edges of said second housing part.

3. A clipboard as claimed in claim 2, wherein at least one of said opposed walls has a positioning groove formed in said outermost side surface thereof, said second housing part having a retaining plate projecting outward from one of said two longitudinal edges thereof so as to extend through said positioning groove in said first housing part, said torsional spring unit pressing against an outer end portion of said retaining plate.

* * * * *